US005298040A

United States Patent [19]

Gosset et al.

[11] Patent Number: 5,298,040

[45] Date of Patent: Mar. 29, 1994

[54] PROCESS FOR THE PREPARATION OF A WATER-RESISTANT FUEL AGGLOMERATE

[75] Inventors: Serge Gosset, Lestrem; Jean-Pierre Graux, Lillers, both of France

[73] Assignee: Roquette Freres, Lestrem, France

[21] Appl. No.: 890,207

[22] Filed: May 29, 1992

Related U.S. Application Data

[63] Continuation-in-part of Ser. No. 534,642, Jun. 7, 1990, abandoned.

[30] Foreign Application Priority Data

Jun. 9, 1989 [FR] France ..... 89 07679

[51] Int. Cl.[5] ..... C10L 5/14

[52] U.S. Cl. ..... 44/560; 44/554

[58] Field of Search ..... 44/558, 560, 554

[56] References Cited

U.S. PATENT DOCUMENTS

| | | | |
|---|---|---|---|
| 3,304,161 | 2/1967 | McGoff | 44/17 |
| 3,402,032 | 9/1968 | Schick | 44/558 |
| 3,402,033 | 9/1968 | Starr | 44/558 |
| 3,485,599 | 12/1969 | Richardson et al. | 44/558 |
| 3,726,652 | 4/1973 | Schick | 44/14 |
| 3,955,937 | 5/1976 | Whang | 44/558 |
| 4,981,494 | 1/1991 | Breuil et al. | 44/560 |
| 5,009,671 | 4/1991 | Franke et al. | 44/560 |

OTHER PUBLICATIONS

French Search Report No. 8907679 dated Mar. 16, 1990.

*Primary Examiner*—Jacqueline V. Howard
*Attorney, Agent, or Firm*—Keck, Mahin & Cate

[57] ABSTRACT

Process for the preparation of a water-resistant fuel agglomerate, characterized by the fact:

that there are employed a finely divided fuel material, an organic binder and an oxidizing agent, that the oxidizing agent is mixed with either the fuel material, or the organic binder, or with one or other of these products or their mixture, that the mixture so obtained is subjected to an agglomeration treatment, and that the agglomerate obtained at the end of the agglomeration treatment is subjected to a stoving treatment.

15 Claims, No Drawings

PROCESS FOR THE PREPARATION OF A WATER-RESISTANT FUEL AGGLOMERATE

This application is a continuation-in-part of U.S. application Ser. No. 07/534,642 filed Jun. 7, 1990 now abandoned.

BACKGROUND OF THE INVENTION

The invention relates to a process for the preparation of a water resistant fuel agglomerate. It is directed also to the composition of matter employed in this process.

By the expression "fuel agglomerates", is meant any physical presentation of finely divided fuel materials which are easily handled and useful for domestic or industrial purposes. By way of example may be mentioned nuts, briquets and pellets.

The finally divided fuel materials concerned by the present invention may be any substances rich in carbon, like for example coal fines or dusts, wood fines, coal coke fines, fines of petroleum coke or a mixture of these products. These materials and in particular coal fines and dusts are produced in large amounts by modern methods of extraction and washing, particularly of coal.

Among the value-enhancing uses of these materials, may be mentioned more particularly their use in the form of fuel agglomerates.

Different techniques of agglomeration of these fines or dusts, generally employing additives or binders suitable for ensuring sufficient cohesion, have already been proposed.

Among these additives or binders, the most employed currently are tar from coal, from wood or from petroleum, lignosulfonates, clays, polysaccharides among which in particular are starches and starch derivatives.

The most used of these binders is incontestably coal tar, but the exigencies as regards protection of the environment becoming more and more strict, its use today shows a certain recession.

In fact, its use makes it necessary to submit the agglomerates so obtained to a heat treatment or fume reduction treatment in order to lower the concentration of phenolic compounds. Now this treatment results in a non negligible atmospheric pollution. Moreover, the fume reduction treatment not being complete, the combustion of these agglomerates at the time of their use causes a release of smoke noxious to man.

These drawbacks have led certain countries to forbid their use.

The drawbacks inherent in the use of tar reoccur during the use of bitumen as binder.

To overcome these drawbacks, it has been proposed to resort, as binder, to lignosulfonates, in particular that of ammonium.

The scientific literature relating to the use of these products is extremely abundant and there may be mentioned by way of example patents SU 983.147, SU 1.010.146 and SU 1.137.103, patents EP O 097 486 and DE 3.277.395 or again patents DD 224.331 and U.S. Pat. No. 4,666,522.

It happens that the technique of agglomeration with lignosulfonates is complex and its performance requires considerable mastery. In particular, it is necessary to dry the fines to a precise moisture content so that the lignosulfonates-fines mixture may be agglomerated, an excess or a lack of moisture making this operation impossible.

On the other hand, in the heat treatment, to polymerise the lignosulfonates and thus to confer on the agglomerates a good resistance to water, there is produced a disengagement of noxious fumes rich in sulfuric acid, a non negligible cause of atmospheric pollution.

It has been proposed to resolve this pollution problem by applying different arrangements to the installations concerned, and particularly by providing smoke condensing devices. But such devices have only had the result of displacing the pollution problem to a corrosion problem which it is known to have been extremely difficult to control especially when it is a matter of treating condensates rich in sulfuric acid, even by employing special steel as constituent material of the agglomeration installations. In any event and whatever the solutions envisaged, the drawbacks associated with the use of lignosulfonates make it a laborious technique.

Moreover, the agglomerates manufactured according to this technique show the drawback of generating, during their combustion, sulfurous residues which are again found particularly in the smoke.

Processes have been proposed not showing the above mentioned drawbacks associated with pitch, with tar and with the lignosulfonates, in which the binders are replaced by clays particularly by bentonite (U.S. Pat. No. 4,025,596 and DE 1.671.365). However, the agglomerates obtained according to these techniques do not all show the required physical properties; in particular, their mechanical strength is insufficient and their behaviour with water mediocre. Consequently these processes have not been developed in practice.

It has also been proposed to resort, as binder, to starch which, used along or in a mixture with other binders, as taught, for example, by patents U.S. Pat. No. 3,726,652 and DE 3,227,395 or again patent EP 0 097 486, shows numerous advantages.

A comparative study on pelletisation done in 1982 at the University of Berkeley (thesis of K. V. S. SASTRY and D. W. FUERSTENAU), showed that, with respect to an asphalt emulsion, or to bentonite, starch led to better results on the scores:

of resistance to mechanical compression,
of abrasion resistance,
of impact resistance.

Moreover, starch may be used without limitation in industrial plants initially designed in the use of tar or bitumen which are the binders most used currently, its employment hence not requiring an additional investment; in addition, maintenance of the plants is reduced.

Finally, combustion of agglomerates bound with starch does not generate a toxic and/or polluting smoke.

However, and this constitutes a major drawback, agglomerates based on starch, just as those based on bentonite, show a very distinct sensitivity to water, making their storage in the open air impossible.

It has been proposed, to overcome this drawback, to associate starch with tar, with asphalt or with bitumen or again to insolubilize the starch with resins of the urea-formol, phenol-formol, melamine-formol, ketone-formol type or their admixture.

None of the solutions is satisfactory since all rest on the problem of release of toxic and polluting smoke during the combustion of the agglomerates so obtained.

It has also been proposed (see U.S. Pat. No. 1,507,673), to render these fuel agglomerates based on carbohydrates water resistant, to incorporate therein a strong acid in proportions which are not negligible, among which are in particular phosphoric acid, and to treat said agglomerates at a temperature comprised at a temperature comprised between 200° and 540° C.

This solution is not satisfactory since, during the treatment, there remains, as for the lignosulfonates, the problem of release of corrosive fumes. In addition, the handling of strong acid is always a delicate and hence constraining operation.

It has also been proposed to coat the agglomerates with a water-repellent sheet or film obtained by the application of an emulsified wax. Although original, such a solution is laborious through the amount of wax employed and the protection against moisture so conferred on the agglomerates may be altered if these agglomerates undergo, in the course of their transportation, impacts resulting in a deterioration of the protective sheet.

It has lastly been proposed (see patent EP 89 400071) to prepare water resistant fuel agglomerates comprising, distributed within their constituent mass, on the one hand, a carbohydrate as binder and, on the other hand, an organosilicic agent as a water repellent agent.

Such agglomerates, although having suitable resistance to bad weather have the drawback of having a relatively fragile surface condition when they are moist. Such sensitivity is manifested by a well known deterioration of their skin during their handling, thus generating dust in non negligible amount.

Consequently, none of the existing processes enable the production, under economically and ecologically acceptable conditions, of fuel agglomerates having simultaneously satisfactory mechanical properties and behaviour to water.

GENERAL DESCRIPTION OF THE INVENTION

It is accordingly an object of the invention to overcome the drawbacks of the prior art and to provide a fuel agglomerate responding better than those preexisting to the various exigencies or practice.

Applicants have had the merit of discovering that this objective was obtained by agglomerating a finely divided fuel material with an organic binder and an oxidizing agent and by subjecting the agglomerate thus obtained to stoving treatment.

Accordingly, the process for preparing water-resistant fuel agglomerates according to the invention is characterized by the fact:

- that a finely divided fuel material, an organic binder and an oxidizing agent are employed,
- that the oxidizing agent is mixed with either the fuel material, or the organic binder, or with one and other of these products or their mixture,
- that the mixture so obtained is subjected to an agglomeration treatment,
- that the agglomerate obtained at the end of the agglomeration treatment is subjected to a stoving treatment.

According to an advantageous embodiment of the process according to the invention, the organic binder is selected from the group comprising molasses, celluloses, hemicelluloses, flours, proteins, starches, derivatives of these products and their mixtures, starches and derivatives of starch being preferred.

According to another advantageous embodiment of the process according to the invention, the oxidizing agent is a water-soluble oxidizing agent selected from the group comprising hypochlorides, perborates, persulfates, percarbonates, bromates, peroxides and their mixtures, persulfates being preferred, ammonium persulfate being particularly preferred. The oxidizing agent has the effect of converting, during the stoving treatment carried out at a high temperature, the organic binder into binding water insoluble compounds, thereby rendering the fuel agglomerate water-resistant.

It may be interesting to associate with the action of these oxidizing agents that of duly selected metal ions recognized for their catalytic power with respect to oxidation reactions. May be mentioned by way of example, copper, zinc, iron and other bivalent metal ions.

When the organic binder entering into the process according to the invention is a starch or a starch derivative, by these terms are meant,

- as regards the starch, native starches of any origin, natural or hybrid starches derived, for example, from potato, manioc, corn, waxy corn, maize with a high amylose content, wheat and granulometric fractions which may be made therefrom, barley and sorghum,
- as regards the starch derivative, physically and/or chemically modified starches.

Advantageously the organic binder is a native starch, possibly rendered soluble in cold water by the physical treatment of cooking-extrusion and/or of gelatinization on a drum.

With respect to the weights of finely divided fuel materials, there are employed in the process according to the invention:

- a proportion of 0,2 to 25% by weight of organic binder, preferably from 1 to 15% by weight and, more preferably still, from 2 to 7% by weight,
- a proportion of 0.01 to 10% by weight of oxidizing agent, preferably from 0,01 to 3% by weight, and more preferably still, from 0,05 to 3% by weight.

According to an advantageous embodiment of the process of the invention, the water-soluble oxidizing agent may be added in powder form to the finely divided fuel material and/or to the organic binder and/or to the mixture of both.

According to another preferred embodiment, the oxidizing agent may be added in aqueous solution to the fuel material and/or to the mixture of said material and the organic binder.

According to the process relating to the invention, the agglomeration technique employed is selected from the group comprising pelletisation, pressure-compacting, extrusion and molding; these techniques are in themselves known and described in the patent EP 097 486.

In addition, still according to the abovesaid process, the agglomerate obtained at the end of the agglomeration treatment is subjected to a stoving treatment under temperature conditions in the range between about 150° C. and 500° C., preferably between 170° C. and 300° C. A temperature higher than 150° C. and preferably higher than 170° C. is indeed necessary to oxidatively convert the organic binder into binding water insoluble compounds. More preferably, the stoving treatment is performed at a temperature between 190° C. and 250° C.

According to another advantageous embodiment of the process according the invention, at least one organosilicic water-proofing agent is added to the finely divided fuel material, to the organic binder, to the oxidizing agent or their mixtures in order to limite possible risks of taking up water again by capillarity of the fuel agglomerates obtained following the process according to the invention during their exposure to bad weather.

Preferably, the organosilic water-proofing agent is a compound whose structural unit is represented by the formula:

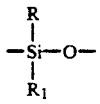

(I)

in which R and $R_1$, which may be identical or different from one another, are organic radicals, said compound being preferably selected from the group comprising non-reactive silicone oils, silicone resins, reactive silicone oils, particularly hydroxylated, alkylated, arylated, hydroalkylated, hydroarylated as well as mixtures of these products and the emulsions which may be prepared from these products.

Or again, compounds selected from the group of siliconates of the general formula:

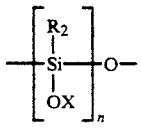

(II)

in which $R_2$ is a alkyl, alkenyl or aryl group,

X is an alkali or alkaline-earth metal and $1 \leqq n \leqq 10$, potassium siliconate being preferred.

The composition of matter employed in this advantageous embodiment of the process according to the invention constitutes, within the scope of this particular application, a novel industrial product under the same title as the fuel agglomerates so obtained.

According to another embodiment of the invention, it is possible to include with the agglomerates other constituents like, for example, carbonates, quick or slaked lime, dolomite, alkaline silicates, clays, latex, borax, polyphosphates, phosphates, concentrated milk and/or whey, cement, polyvinyl alcohols and thermo-setting resins. The proportion of these constituents may reach 15% by weight with respect to the weight of finely divided materials; the granulometric distribution of these constituents must be preferably close to that of the finely material.

DESCRIPTION OF PREFERRED EMBODIMENTS

The invention will be better understood by means of the examples which follow and which relate to advantageous embodiments.

EXAMPLE 1

Nuts based on charcoal dusts/Control

Into a mixer, are introduced, on one hand, 50 kg of coal dusts having a granulometry less than 1 mm and, on the other hand, 3 kg of native wheat starch. This mixture is heated to 50° C. and there is then introduced therein 4.5 liters of water. The mixture so obtained is malaxated for a quarter of an hour with heating raising the temperature to 90° C.; the final humidity measured by means of a moisture balance known under the name CENCO is then 8.5%. The mixture is agglomerated by pression-compacting on a press of the SAHUT CONREUR type; among the parameters of the treatment, the temperature of the mixture, which at the time of agglomeration, is about 70° C., the pressure of adjustment of the presses is 16.7 $10^5$ N/m linear, the speed of the rolls of the press is 5 rpm and the power of the press is 6 kW.

In this manner coal nuts are obtained showing sufficient cohesion when freshly prepared to be able to withstand transportation.

The strength of these nuts, determined by means of a counterweight compressiometer developed by the SAHUT CONREUR Company, showed the following values:

freshly prepared . . . 294.3N after 24 hours drying at ambiant temperature . . . 686.7N after stoving for one hour at 100° C. followed by stoving for one hour at 130° C. . . . 1765.8N.

These nuts are then immersed in cold water. It is observed that they disintegrate very rapidly. After some minutes, the agglomerate shows no cohesion.

These results illustrate the possibility, by using only a binder of the starch type, of producing agglomerates of coal dusts having good mechanical properties but which do not withstand water.

EXAMPLE 2

Nuts of coal dusts according to the invention

In a mixer, 50 kg of coal dust with characteristics identical with those of the dust of Example 1 and 2.5 kg of native wheat starch were intimately mixed.

The mixture obtained was heated under kneading to a temperature of 50° C. Then 25 grams of ammonium persulfate diluted in 2.5 liters of water were added. This mixture was kneaded for a quarter of an hour bringing the temperature of the mixture to 90° C.; the final humidity was then 8%. The mixture was then subjected to an agglomeration treatment by pressure-compacting under the same conditions as in Example 1.

In this way, coal dust nuts are obtained having sufficient cohesion when fresh to be able to undergo transportion. The latter are then subjected to stoving for a period of two hours at a temperature of 220° C.

The strength of these nuts, measured as in Example 1, shows the following values:

when fresh . . . 200N after stoving for two hours at 220° C. . . . 1300N

These nuts are then immersed in cold water. No disagregation was observed even after several hours of immersion.

The mechanical strength of the nuts remained unchanged after their dwell in water and no degradation of their surface condition was observed during their handling after immersion.

This example shows that the addition of 5% of native starch and 0.05% of ammonium persulfate by dry weight with respect to the weight of fuel dust, enables agglomerates to be obtained satisfying the requirements of the technique from the point of view of mechanical strength and behaviour to water.

EXAMPLE 3

Coal dust nuts according to the invention

To a mixture of coal dust and starch identical with that of Example 2 and this under the same conditions, 50 g of sodium perborate was added. Then the mixture was subjected to the same treatment as the mixture of Example 2. The final humidity of the mixture was identical with that of Example 2.

In this way coal dust fines were obtained having sufficient cohesion when fresh to undergo transportion. These nuts were then subjected to stoving for two hours at a temperature of 220° C.

The strength of these nuts, measured as in Example 1, showed the following values:

when fresh . . . 350N after stoving for two hours at 220° C. . . . 1100N.

These nuts were then immersed in cold water. No disagregation was observed even after several months' immersion.

Their mechanical strength remained unchanged after their dwell in water and after simple drainage. No degradation of their surface condition was observed.

This example shows that the addition of 5% of native starch and 0.1% of sodium perborate by dry weight with respect to the weight of fuel dust enables agglomerates to be obtained satisfying the requirements of the technique both from the point of view of mechanical strength and behaviour to water.

EXAMPLE 4

Coal dust nuts according to the invention

To a mixture of coal dust, starch and ammonium persulfate identical with that of Example 2 were added 100 g of water-proofing agent of the RHODORSIL SILICONATE 51 T type (potassium siliconate marketed by RHONE-POULENC with about 49% of dry matter).

The mixture was subjected to the same treatments as the mixture of Example 2. In this way nuts of coal dust were obtained having a sufficient cohesion when fresh to undergo transportion. These nuts were then subjected to stoving for two hours at a temperature of 230° C.

The strength of these nuts, measured as in Example 1, had the following values:

when fresh . . . 200N after stoving for two hours at 230° C. . . . 1400N.

These nuts were then immersed in cold water for one hour. After this dwell, their take-up of water again was only 1.6%.

The mechanical strength of the nuts remained unchanged after their dwell in water and no degradation of their surface condition was observed during their handling after immersion.

This example shows that the addition of 5% of native starch and 0.05% of ammonium persulfate and of 0.1% of potassium siliconate by dry weight with respect to the weight of fuel dust enabled agglomerates to be obtained satisfying the requirements of the technology from the point of view of mechanical strength and behaviour to water, and enabled also the retake-up of water of these agglomerates to be considerably limited when the latter is undesirable.

We claim:

1. A process for the preparation of a water-resistant fuel agglomerate, comprising:

selecting a finely divided fuel material, mixing said fuel material with 0.2 to 25% by weight, with respect to the weight of the finely divided fuel material, of organic binder selected from the group consisting of molasses, flours, starches, derivatives of these products and their mixtures, and with 0.01 to 3% by weight, with respect to the weight of the finely divided fuel material, of water-soluble oxidizing agent selected from the group consisting of perborates, persulfates, percarbonates, peroxides and their mixtures, subjecting the mixture so obtained to agglomeration treatment, and subjecting the agglomerate obtained at the end of the agglomeration treatment to stoving treatment at a temperature in the range between about 170° C. and about 300° C., thereby oxidatively converting the binder into binding water-insoluble compounds, and thereby rendering the fuel agglomerate water-resistant.

2. Process according to claim 1, wherein the organic binder comprises a member selected from the group consisting of starches and derivatives of starches.

3. Process according to claim 1, wherein the oxidizing agent comprises a member selected from the group consisting of persulfates.

4. Process according to claim 3, wherein the oxidizing agent comprises ammonium persulfate.

5. Process according to claim 1, wherein the agglomeration treatment used is selected from the group consisting of pelletization, pressure-compacting, extrusion and molding.

6. Process according to claim 5, wherein the temperature conditions of the stoving treatment are between about 190° C. and about 250° C.

7. Process according to claim 2, wherein the organic binder is a native starch rendered soluble in cold water by physical treatment of cooking-extrusion and/or of gelatinization on a drum.

8. Process according to claim 1, wherein, the organic binder comprises 1 to 15% by weight of the weight of the finely divided fuel material.

9. Process according to claim 8, wherein, the organic binder comprises 2 to 7% by weight of the weight of finely divided fuel material.

10. Process according to claim 1, wherein organosilicic water-proofing agent is added to a member selected from the group consisting of the finely divided fuel material, the organic binder, the oxidizing agent and mixtures thereof.

11. Process according to claim 10, wherein the organosilicic water-proofing agent comprises a compound including a structure unit represented by the formula:

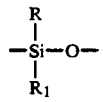

(I)

wherein R and $R_1$, which may be the same or different, are organic radicals.

12. Process according to claim 10, wherein the organosilicic water-proofing agent comprises a compound selected from the group of siliconates of the general formula:

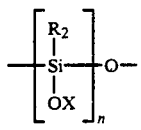

(II)

in which $R_2$ is an alkyl, alkenyl or aryl group,

X is an alkali or alkaline earth metal atom, and $1 \leqq n \leqq 10$.

13. Process according to claim 12, wherein the organosilicic water-proofing agent comprises potassium siliconate.

14. Process according to claim 11, wherein the organosilicic water-proofing agent comprises a compound of formula (I) selected from the group consisting of non-reactive silicone oils, silicone resins, reactive silicone oils mixtures thereof and emulsions which may be prepared therefrom.

15. Process according to claim 14, wherein the compound of formula (I) is hydroxylated, alkylated, arylated, hydroalkylated or hydroarylated.

* * * * *

UNITED STATES PATENT AND TRADEMARK OFFICE

CERTIFICATE OF CORRECTION

PATENT NO. : 5,298,040
DATED : March 29, 1994
INVENTOR(S) : Serge Gosset et al.

It is certified that error appears in the above-indentified patent and that said Letters Patent is hereby corrected as shown below:

Column 1, line 18, please replace "finally" with --finely--.

Column 2, line 33,please replace "along" with --alone--.

Column 3, line 2, please remove "at a temperature comprised" (second occurrence).

Column 4, line 67, please replace "limite" with --limit--.

Signed and Sealed this

Twenty-third Day of August, 1994

*Attest:*

*Attesting Officer*

BRUCE LEHMAN

*Commissioner of Patents and Trademarks*